US009695667B2

(12) United States Patent
Sears et al.

(10) Patent No.: US 9,695,667 B2
(45) Date of Patent: Jul. 4, 2017

(54) APPARATUS AND METHOD FOR DEPLOYING AN ELECTRICALLY OPERATED PUMP IN A WELLBORE

(71) Applicant: ZiLift Holdings, Limited, Aberdeen (GB)

(72) Inventors: Kenneth John Sears, Aberdeen (GB); Jamie Cochran, Inverurie (GB)

(73) Assignee: ZiLift Holdings, Ltd., Aberdeen (GB)

( * ) Notice: Subject to any disclaimer, the term of this patent is extended or adjusted under 35 U.S.C. 154(b) by 448 days.

(21) Appl. No.: 14/471,376

(22) Filed: Aug. 28, 2014

(65) Prior Publication Data

US 2016/0061010 A1 Mar. 3, 2016

(51) Int. Cl.
*E21B 33/127* (2006.01)
*E21B 43/12* (2006.01)

(52) U.S. Cl.
CPC ..... *E21B 33/1275* (2013.01); *E21B 43/128* (2013.01)

(58) Field of Classification Search
CPC .. E21B 33/1275; E21B 33/127; E21B 43/128; E21B 43/12; E21B 34/10
See application file for complete search history.

(56) References Cited

U.S. PATENT DOCUMENTS 5,404,946 A * 4/1995 Hess ..... E21B 33/1275 166/187

* cited by examiner

*Primary Examiner* — Wei Wang
(74) *Attorney, Agent, or Firm* — Richard A. Fagin

(57) ABSTRACT

An electrical submersible pump system includes an electric motor operably coupled to a fluid pump which includes first and second fluid ports. The first and second ports are selectively operable as a fluid intake and a fluid discharge of the fluid pump with reversal of a direction of rotation of the fluid pump. Valves in the system are controllable to selectively direct fluid discharge of the fluid pump to an inflation volume of the inflatable packer and toward the surface in a wellbore tubing. The valves are further controllable to vent pressure in the inflation volume to deflate the packer.

33 Claims, 7 Drawing Sheets

APPARATUS AND METHOD FOR DEPLOYING AN ELECTRICALLY OPERATED PUMP IN A WELLBORE

BACKGROUND

This disclosure is related to the field of electrically operated submersible well pumps (ESPs). More specifically, the disclosure relates to structures for ESP systems and methods for deploying, moving and redeploying an ESP through a wellbore tubing.

ESPs are known in the art for lifting liquid in a subsurface wellbore, as examples, in cases where energy in a subsurface reservoir penetrated by the wellbore is insufficient to lift the fluid to the surface, or where liquid produced from the formation such as water increases hydrostatic pressure in the wellbore so as to reduce productivity of the reservoir of desirable fluids such as oil or more particularly gas. The latter use is known as "dewatering."

ESP systems known in the art may be deployed in the wellbore at the end of a section of conduit called "tubing" or a "velocity string", which has a nominal diameter smaller than an internal diameter of a pipe or casing permanently emplaced in the wellbore. The casing serves to maintain mechanical integrity of the wellbore and to hydraulically isolate subsurface formations from each other. The tubing may serve the purpose of providing a smaller diameter conduit to increase the velocity of fluid moving to the surface, thus increasing capacity of wellbore fluid to lift higher density fluid components to the surface for a given amount of total energy (i.e., from the reservoir and from a pump if used).

Certain types of electrical cables may make practical the deployment of ESP systems through an emplaced tubing. Such capability may reduce the cost of deploying, servicing and/or replacing an ESP system as compared to those deployed at the end of a tubing.

In some cases it may be desired to be able to move the ESP after initial deployment and/or to repeatably seal the interior of the tubing after such movement without the need to completely remove the ESP system from the wellbore.

DETAILED DESCRIPTION

Figure 1:
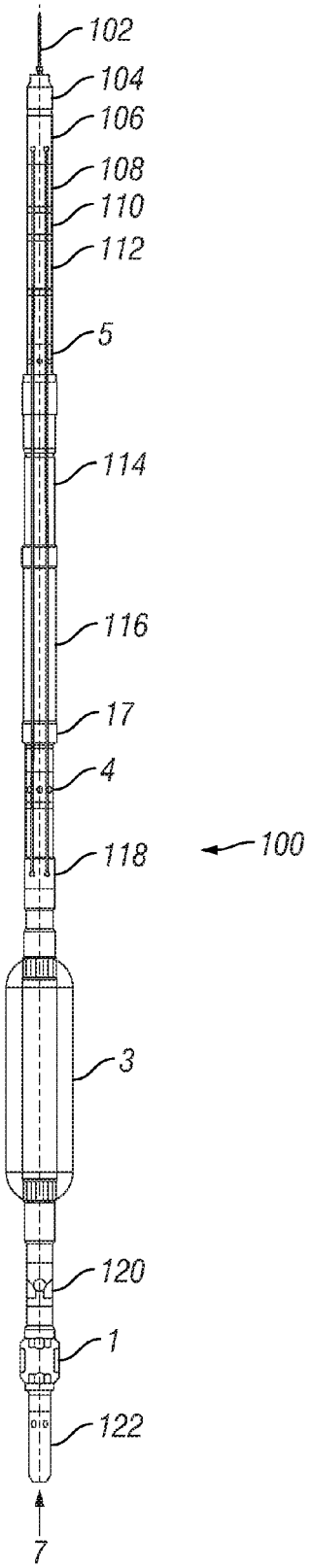
FIG. 1 shows an example arrangement of an ESP system deployable in a wellbore on an electrical cable.

An aspect or embodiment according to the present disclosure relates to an electrical submersible pump (ESP) system comprising an electric motor operably coupled to a fluid pump having first and second ports selectively operable as a pump inlet and a pump discharge with reversal of a direction of rotation of the fluid pump. This ESP system includes an inflatable seal element. and controllable valves to selectively direct fluid discharge of the fluid pump to an inflation volume of the inflatable seal element and toward the surface in a wellbore.

The inflatable seal element when inflated may serve firstly to provide a seal against the bore of the tubing to support the pump differential pressure; secondly to provide a torque restraint for the pump unit; and thirdly, to support all or part of the weight of the pump assembly and cable weight in some embodiments.

The ESP system may comprise a torque converter disposed between the electric motor and the fluid pump in some embodiments.

The ESP system may comprise a protector disposed between the electric motor and the pump in some embodiments.

In some embodiments, the ESP system may further comprise one or more of the following: a cable head coupled to a longitudinal end of the electric motor, and which may be configured to couple the ESP system to an electrical cable. The electrical cable may be for use in moving the ESP system along an interior of a wellbore. The cable connection may include a swivel so that the pump unit can rotate without twisting the cable. In some embodiments other deployment medium may be utilized, such as coiled tubing, for example.

The electric motor may be operable to rotate the pump in a first direction in which the first fluid port functions as a pump discharge and the second fluid port functions as a pump inlet. In such an arrangement the valves may be controlled or operated to hydraulically connect the first fluid port to the inflation volume, whereby operation of the fluid pump introduces fluid under pressure to the inflation volume in the inflatable seal element.

The electric motor may be operable to rotate the pump in a second direction opposite to the first direction in which the first fluid port functions as a pump inlet and the second fluid port functions as a pump discharge. In such an arrangement the valves may be controlled to hydraulically connect the first fluid port to the wellbore on one side of the inflatable seal element and to hydraulically connect the second port to the wellbore on an opposite side of the inflatable packer.

In some embodiments, the ESP system may comprise a pressure relief valve in hydraulic communication between the second fluid port on the fluid pump and the wellbore.

In some embodiments, the ESP system may comprise a pressure relief valve in hydraulic communication between the inflation volume and the wellbore tubing.

In some embodiments, the ESP system may comprise a check valve operable to admit fluid to the first fluid port when the fluid pump is rotated such that the first fluid port operates as a pump inlet, the check valve operable to stop fluid flow therethrough when the fluid pump is rotated such that the first fluid port operates as a pump discharge.

In some embodiments, the controllable valves may be controllable to vent pressure in the inflation volume to deflate the packer.

In some embodiments, the ESP system may comprise a tubular core having a through bore in fluid communication with the first fluid port. The inflatable seal element may be mounted around the tubular core.

In some embodiments, the ESP system may comprise an inflate port in the tubular core to permit fluid communication between the through bore of the tubular core and the inflation volume of the inflatable seal element. One of the controllable valves may be operable to selectively permit fluid communication through the inflate port.

In some embodiments, the ESP system may comprise a torque anchor disposed at a selected axial position along an assembly formed by the electric motor and the pump.

An aspect or embodiment according to the present disclosure relates to a method for pumping fluid from a wellbore towards surface. Such method may include moving an electrical submersible pump (ESP) system to a selected position in a wellbore, wherein the ESP system includes a pump having first and second ports selectively operable as a pump inlet and a pump discharge with reversal of a direction of rotation of the fluid pump. The pump is rotated in a first direction and valves in the ESP system are operated to direct fluid discharge of the pump to an inflatable seal element in the ESP system. The pump is rotated in a second direction opposed to the first direction and the valves are operated to direct fluid discharge of the pump towards the surface in a wellbore.

The method may comprise, in some embodiments, operating the valves and rotating the pump in the first direction such that a second port in a pump in the ESP system withdraws fluid from the wellbore into the pump and a first port in the pump discharges fluid into the inflatable seal element in the ESP system.

The method may comprise, in some embodiments, operating the valves and rotating the pump in the second direction such that the first port withdraws fluid from the wellbore on one side of the inflatable seal element, for example below the seal element, and the second port discharges fluid into the wellbore on an opposite side of the inflatable seal element, for example above the seal element, toward the surface. The flow may flow or be pumped via a wellbore conduit.

In some embodiments, one or more of the following operations may be performed. Rotating the pump in the first and second directions may comprise operating an electric motor rotationally coupled to the pump in the first and second directions. The valves may be operated to at least partially vent fluid pressure from the inflatable seal element. The ESP system may be moved within the wellbore following at least partially venting fluid pressure from the inflatable seal element.

The method may comprise moving the ESP to a different position within the wellbore and repeating inflating the inflatable seal element at the different position in some embodiments.

The method may comprise repeating reversing pump direction of rotation and pumping fluid toward the surface at the different position in some embodiments.

The method may comprise retrieving the ESP system from the wellbore following at least partially venting fluid pressure from the inflatable seal element in some embodiments.

The method may comprise setting a torque anchor to rotationally lock the ESP system in the conduit in some embodiments.

Setting the torque anchor may comprise starting rotation of the pump to deploy locking arms by centripetal force in some embodiments.

The method may comprise releasing a set torque anchor prior to moving the ESP system by applying an upward axial force on the ESP system in some embodiments.

The method may comprise venting pressure above a preselected amount from the interior of the inflatable seal element in some embodiments.

The method may comprise venting pressure above a preselected amount from the pump when the pump is operated in the first direction in some embodiments.

Moving the ESP system may comprise extending and/or retracting an electrical cable coupled to a longitudinal end of the ESP system in some embodiments.

It is to be understood that both the foregoing summarized description and the following detailed description are only intended as examples of various aspects and embodiments according to the present disclosure. The accompanying drawings are included to provide a further understanding of the embodiments and are incorporated in and constitute a part of the present disclosure.

FIG. 1 shows the general arrangement of an ESP system according to one example embodiment. The ESP system 100 may be coupled to one end of an electrical cable 102. The electrical cable 102 may be coupled to the ESP system 100 by any well-known structure of wellbore electrical tool cable head 104. The electrical cable may provide electrical power and control signals to operate an electric motor 108. An electrical power takeoff and signal decoding sub 106 may be disposed intermediate the cable head 102 and the electric motor 108. The electrical power takeoff and signal decoding sub may include circuitry (not shown separately) of types well known in the art for controlling the operating speed of the electric motor and its direction of rotation in the present example. The sub 106 may also have circuits (not shown separately) for decoding command signals to operate valves in a valve sub 118 (described in more detail below). The electric motor 108 may be any type known in the art used in ESP systems, for example, a multi-phase induction motor. Depending on the type of pump used, a rotational output of the electric motor 100 may be coupled through a torque converter 110. If used, the torque converter 110 may either reduce the rotational speed and increase the torque at its output relative to its input, or vice versa. Rotational output of the torque converter 110 (if used) may pass through a protector/seal assembly 112 and then be coupled through a flexible drive shaft 114 to a pump 116. The pump 116 may be a positive displacement pump such as a progressive cavity pump. The type of pump is not intended to limit the scope of the present disclosure. A fluid discharge for the pump is shown at ports 5. In this respect ports 5 may function as a pump discharge when the pump 116 is operated in a normal or forward direction of rotation. However, when the pump 116 is operated in a reverse direction the ports 5 may function as a pump inlet.

A flow bypass 4 may be disposed below the pump 116. The purpose for the flow bypass will be explained further below. A valve sub 118 may be disposed below the flow bypass 4 and may include valves to be further explained below that may be remotely operated to cause selective operation of various components of the ESP system 100 as required.

An inflatable packer 3 may be disposed below the valve sub 118. The inflatable packer may have an elastomer sealing element to seal an annular space between the exterior of the ESP system 100 and the interior of a wellbore tubing (2 in FIG. 1B). A check valve 120 may be disposed below the packer 3. If used, a torque anchor 1 of types well known in the art may be disposed below the check valve 120. A mule shoe 122 may be disposed below the torque anchor 1. A system fluid inlet 7 may be provided at a bottom of the mule shoe 122. Fluid from below the ESP system 100 may move into the ESP system through the system fluid inlet 7 and may be pumped as will be further explained below.

Figure 1B:
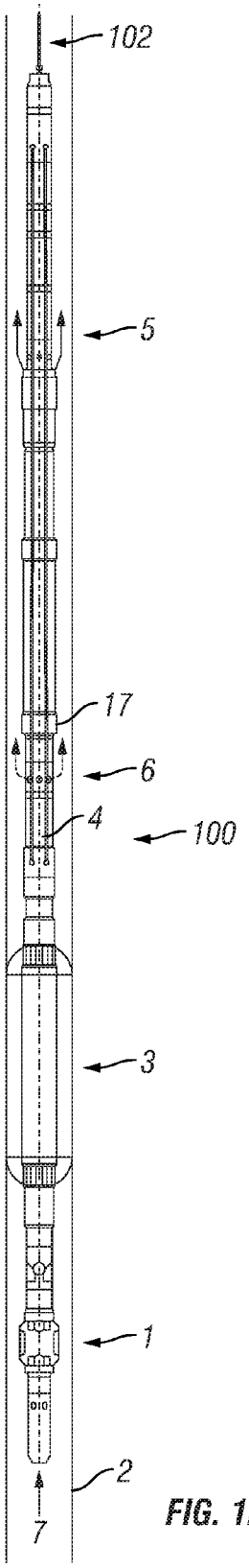
FIG. 1B shows the example ESP system as it would be installed in a wellbore.
Figure 1A:
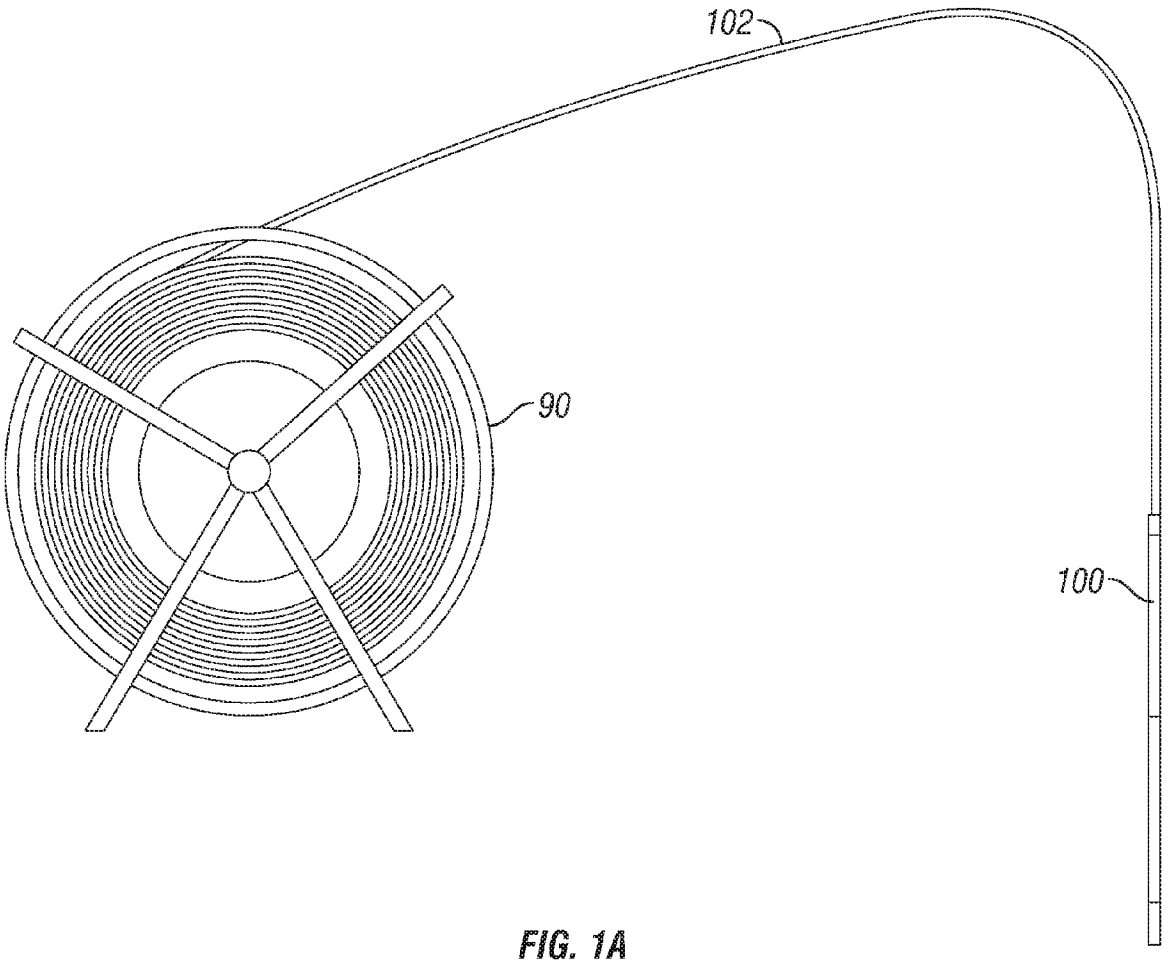
FIG. 1A shows an example method for deployment of the ESP system into a wellbore on a power cable.

FIG. 1A shows an example method for deployment of the ESP system 100 into a wellbore on an electrical cable 102. The electrical cable 102 may be stored on a winch 90 or similar spooling device that may extend and retract the electrical cable 102 so as to move the ESP system 100 to a selected depth in a wellbore.

FIG. 1B shows the example ESP system 100 as it would be installed in a wellbore. When the pump (116 in FIG. 1) is operated, fluid enters at the system fluid inlet 7 and after passing through the pump (116 in FIG. 1), is discharged through the pump discharge ports 5.

The flow bypass 4 may be included in the ESP system 100 as previously explained with reference to FIG. 1. In the case where the ESP system 100 is used to clear kill fluid from a well, when the kill fluid has been cleared from the wellbore, the natural reservoir pressure may be sufficient for fluid flow to move toward the surface without additional energy added, and in some cases may flow at a faster rate than the maximum flow rate of the pump (116 in FIG. 1). The flow bypass 4 provides a flow path for such circumstances. If the subsurface reservoir pressure is greater than the hydrostatic pressure in the tubing 2, i.e., sufficient for natural flow, the flow bypass 4 will allow flow through additional flow paths 6 such that fluid may bypass the normal flow passage through the pump (116 in FIG. 1) and into the tubing 2. If and when natural flow is established, the ESP system 100 may be switched off and retrieved from the tubing 2 as will be further explained below.

Figure 3:
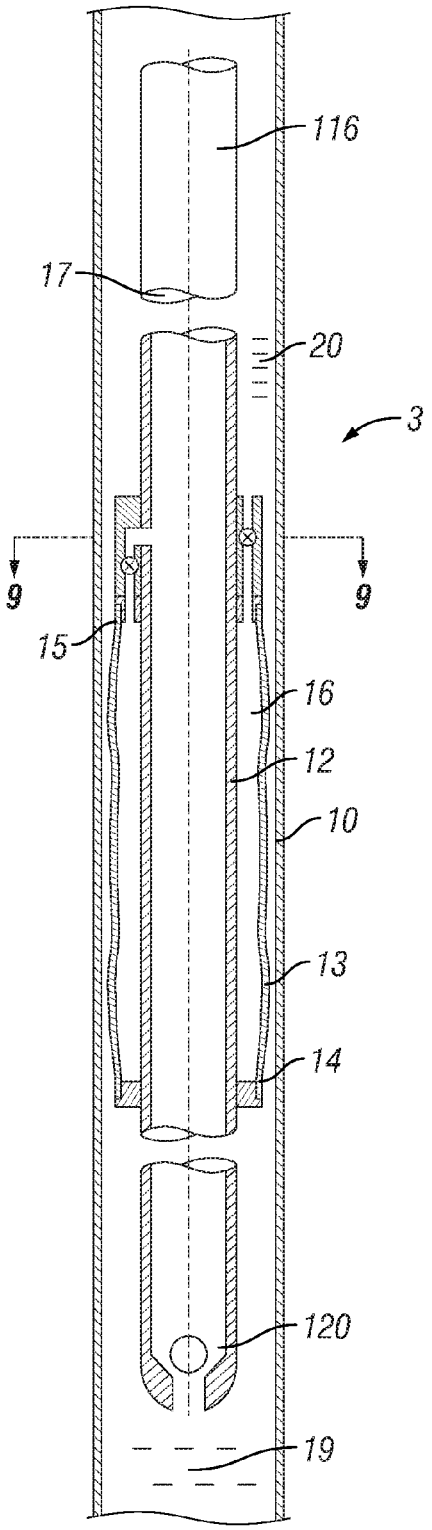
FIG. 3 shows an example inflatable packer in the deflated condition.

FIG. 3 shows the inflatable packer 3 in the deflated condition. The inflatable packer 3 may have a tubular core 12 with a bore through which fluid can flow from the system fluid inlet (7 in FIG. 1) into the pump 116 via a pump port 17. In this respect the pump port 17 may act as a pump inlet when the pump 116 is operated in a normal or forward direction of rotation to pump fluid to surface. However, the pump port 17 may function as a pump discharge when the pump 116 is operated in the opposite direction of rotation.

Circumscribing the core 12 may be a substantially cylindrical seal 13 which may be made from expandable elastomer. The seal 13 may be sealed to the core 12 at its connections at both ends 14, 15, making a pressure-tight annular volume 16 between the core 12 and the seal 13 when the seal 13 is inflated.

The seal 13 may be inflated by applying a higher hydraulic pressure to the annular volume 16 than the pressure which exists outside it. In an example system and method according to the present disclosure, such pressure may be provided by operating the pump (116 in FIG. 1) in the reverse direction to that used to lift wellbore fluid to surface, so that fluid discharged by the pump (116 in FIG. 1) through the pump port 17 develops pressure against the check valve 120 proximate the bottom of the ESP system (100 in FIG. 1). A packer inflation valve (FIG. 5) allows this pressure to be applied to inflate the packer 3.

When the packer 3 is inflated, the seal 13 is pressed tightly against the internal surface 10 of the well tubing 2 which forms a pressure tight seal between the fluid 19 in the tubing 2 below the packer 3 and the fluid in the tubing above the packer 20. The seal provided by the packer 3 enables the pump (116 in FIG. 1) to develop pressure (head) to produce fluid from the wellbore to surface.

Figure 4:
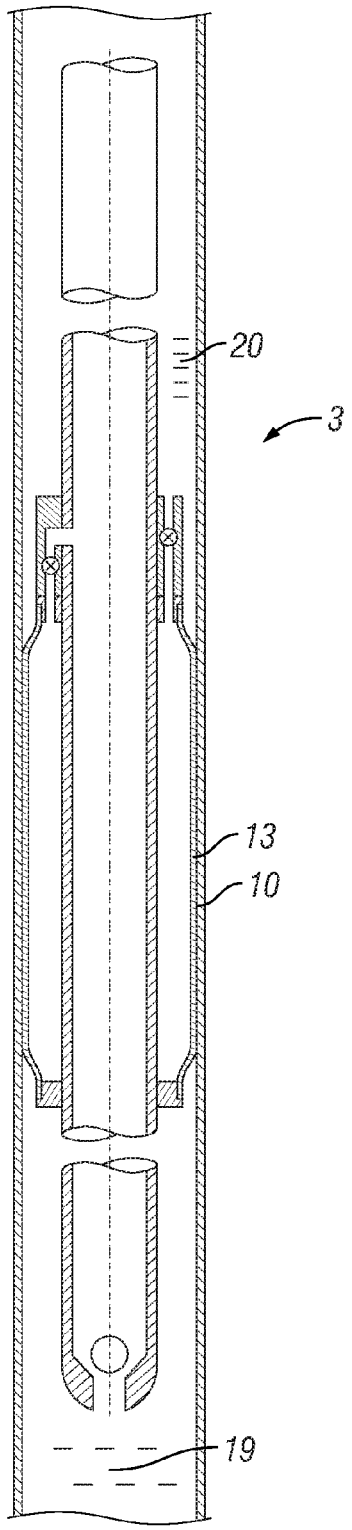
FIG. 4 shows the inflatable packer in the inflated condition.

FIG. 4 shows the packer 3 in the inflated condition. The seal 13 is pressed tightly against the internal surface 10 of the well tubing 2 which forms a pressure tight seal between the fluid in the tubing below the packer (shown at 19) and the fluid in the tubing above the packer (shown at 20). The seal 13 pressed tightly against the internal surface 10 of the well tubing 2 may also provides torque restraint to prevent the ESP system from rotating in the wellbore in response to reactive torque. In situations where this torque restraint is not adequate, or for other reasons, a separate torque anchor may be included in the system, as further described below.

Figure 5:
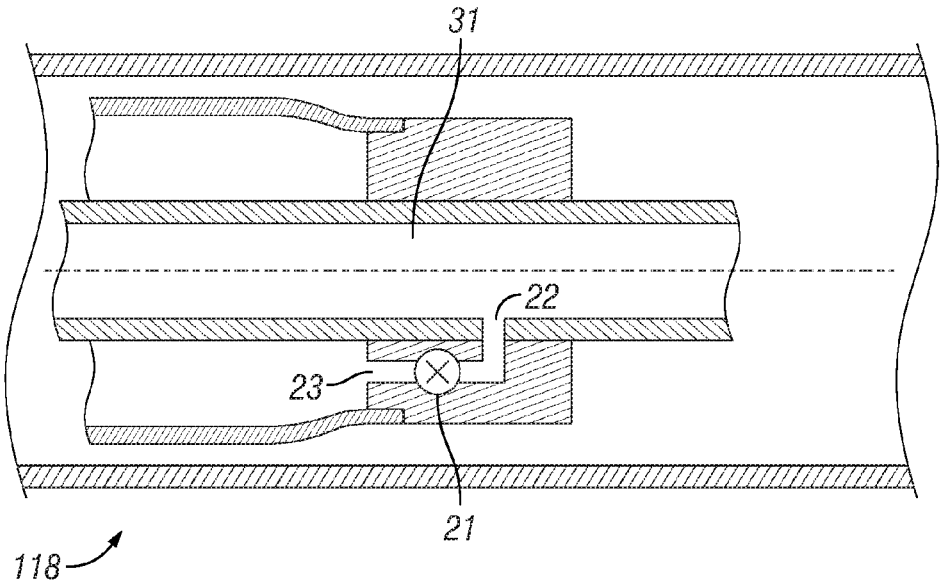
FIG. 5 shows an example packer inflation valve.

Inflation and deflation of the packer may be controlled by valves. Four valve functions may be implemented in some embodiments. FIG. 5 shows an example of the packer inflation valve which may form part of the valve sub 118. To inflate the packer, a first valve 21 may be opened, such as by actuating a solenoid (not shown) to allow a port 22 to connect the pump fluid discharge 31 to a packer inflation port 23. When the packer (3 in FIG. 4) has been inflated, the first valve 21 is shut to retain pressure inside the seal (13 in FIG. 4).

Figure 6:
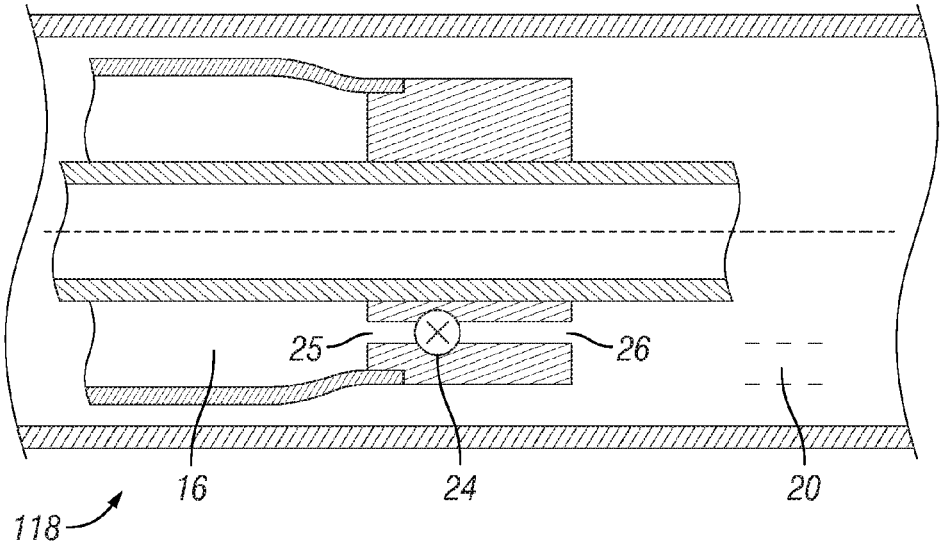
FIG. 6 shows an example packer deflation valve.

FIG. 6 shows a packer deflation (second) valve 24, which may form part of the valve sub (118 in FIG. 1). To deflate the packer, the second valve 24 is opened, e.g., by operating a solenoid to allow fluid to flow from the packer inflation volume (16 in FIG. 4) through a first deflation port 25 and through a second deflation port 26 which connects to the fluid in the wellbore. The deflation valve 24 is shut at all times when the packer is being inflated and is to remain inflated.

Figure 7:
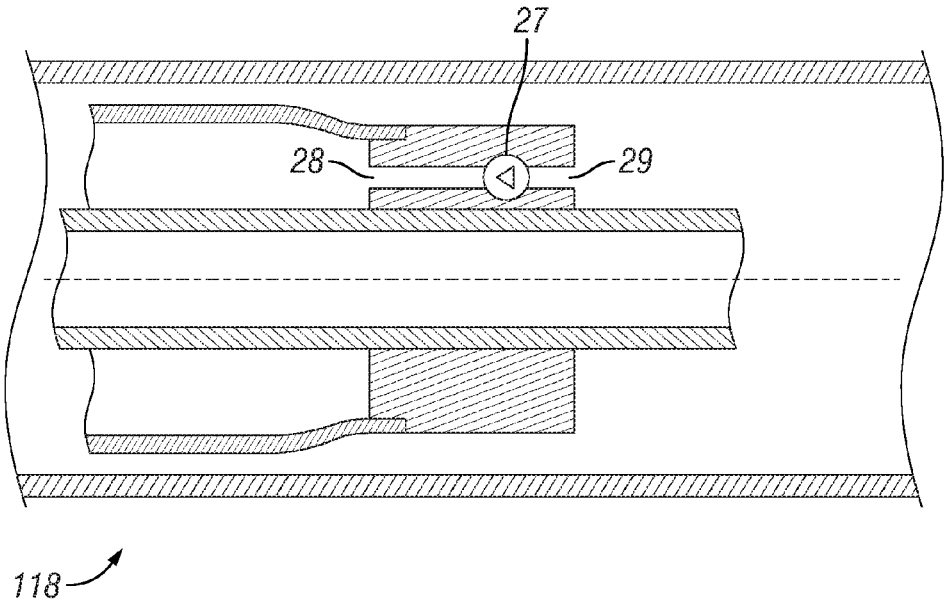
FIG. 7 shows an example packer pressure limiting valve.

FIG. 7 shows an example packer pressure limiting valve 27, which may also be disposed in the valve sub 118. To prevent the packer (3 in FIG. 4) being damaged by inflation to excessive pressure, the packer pressure limiting valve 27 may be configured to vent at a selected pressure such that excess pressure inside the packer inflation volume (16 in FIG. 4) may escape to the wellbore through ports 28 and 29.

Figure 8:
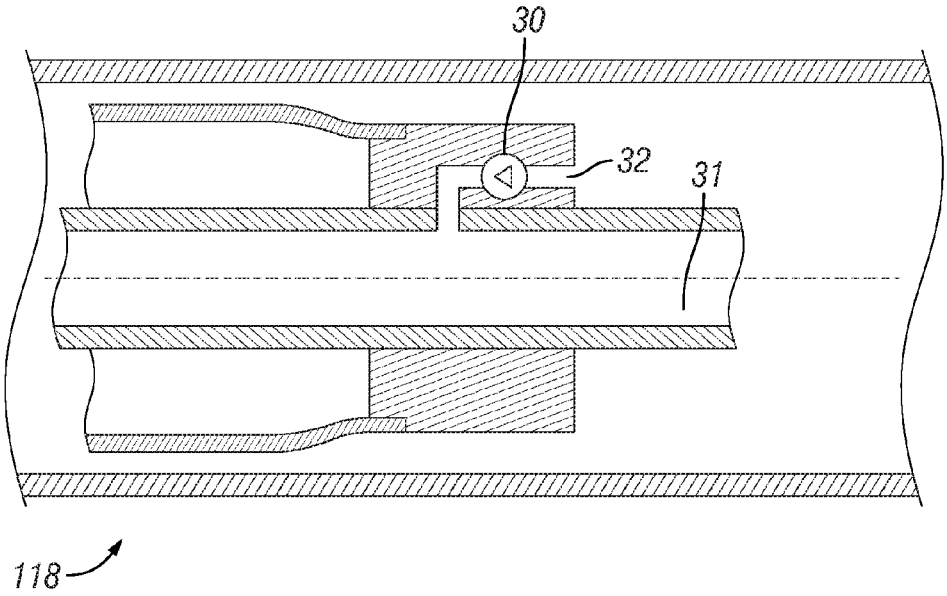
FIG. 8 shows an example pump pressure limiting valve.

FIG. 8 shows an example pump pressure limiting valve 30, which may also be disposed in the valve sub 118. To prevent the pump (116 in FIG. 1) from being damaged by being 'dead-headed' (having its fluid outlet blocked), thereby causing too high a pressure, the pump pressure limiting valve (30) may be configured to open at a selected pressure such that excess pressure inside the pump flow area 31 may be vented to the wellbore through port 32.

Figure 9:
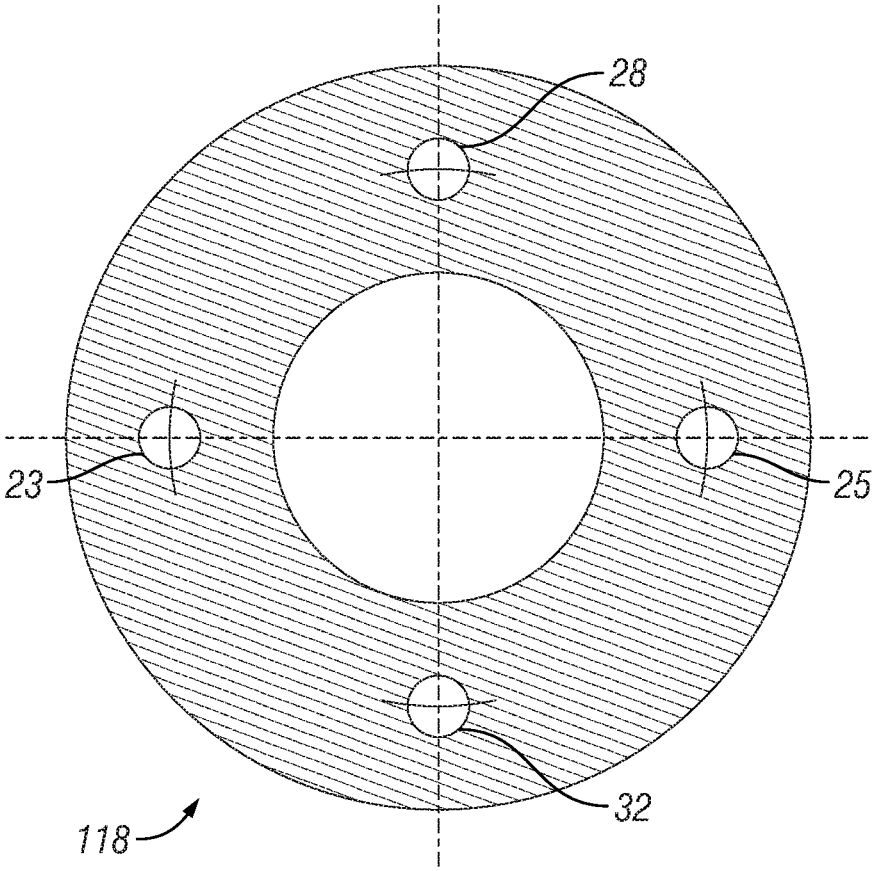
FIG. 9 shows a representative section through an example valve sub.

FIG. 9 shows a representative cross section through the valve sub 118, illustrating one possible orientation of the above described valves, as indicated by the positioning of the ports 23, 25, 28, 32 as described with reference to FIGS. 7 and 8.

Although in the present example embodiment four separate valves are described, in other embodiments it may be possible to combine some of the functions of the foregoing individual valves, and reduce the number of valves in the ESP system. For example, the functions of the packer inflation valve and deflation valve may be included in a single two-way valve, with appropriate modifications to the ports. In some embodiments, it may be desirable to duplicate some valves in order to provide a backup in case of malfunction of one or more of the valves, in order to improve the reliability of the ESP system.

Figure 2A:
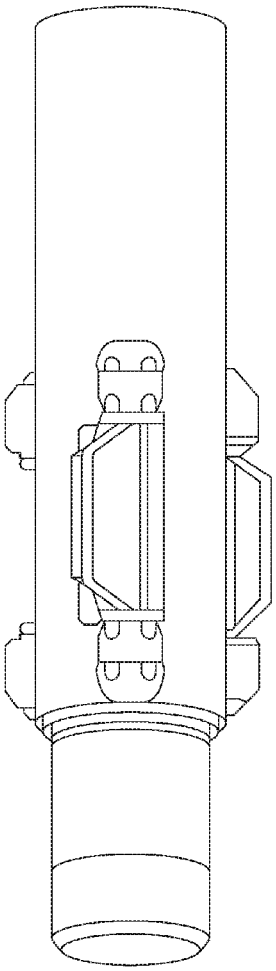
FIG. 2A shows an example torque anchor.
Figure 2B:
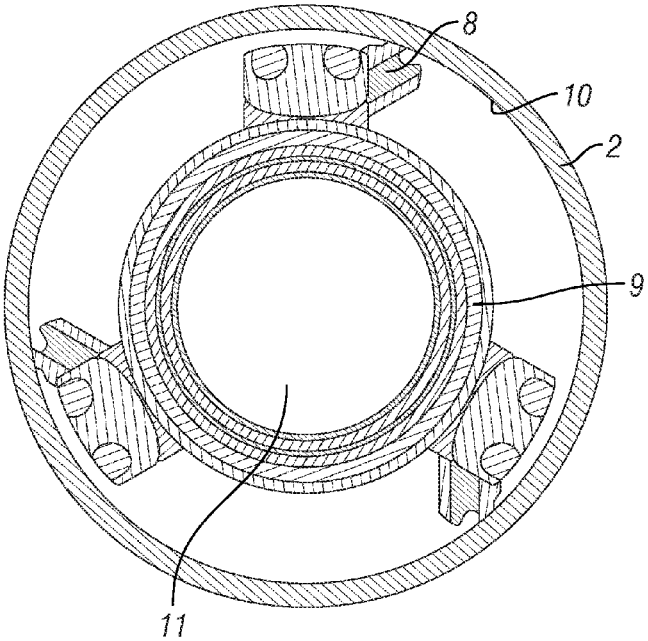
FIG. 2B shows a cross section of functional components thereof.

If the torque anchor 1 is used, to prepare the ESP system 100 for fluid pumping, the torque anchor 1 may be engaged with the internal surface of a wellbore tubing 2. FIG. 2A shows an example embodiment of the torque anchor 1. FIG. 2B shows a cross section through the torque anchor 1 illustrating the functional components thereof. The torque anchor 1 when closed can pass freely through the wellbore tubing (2 in FIG. 1B). When the ESP system 100 is at a selected setting depth, the torque anchor 1 may be operated to provide torsional restraint to the ESP system (100 in FIG.

1). The torque anchor 1 may have a hollow bore (11) through which fluid can flow to the pump (116 in FIG. 1). The torque anchor 1 may include slips 8 which may be pivotally mounted to the body 9 of the torque anchor 1 and may be spring loaded so that they contact the internal surface 10 of the wellbore tubing 2. When a rotational torque is applied, e.g., by starting the electric motor (108 in FIG. 1), the slips 8 may be moved radially outwardly by centripetal force and then grip the internal surface 10 of the tubing 2 with increasing force. The torque anchor 1 when thus set counteracts the reactive torque of the electric motor and pump, and thus prevents the ESP system (100 in FIG. 1) from rotating in the tubing 2.

The torque anchor 1 in some embodiments may be a double acting type, or a combination of two single acting types arranged to resist torque in both directions. The torque anchor 1 may be released by applying tension to the electrical cable. The ESP system (100 in FIG. 1) may then be moved to a different wellbore location or removed from the wellbore by winching on the electrical cable.

An example method for deploying and operating an ESP system as described herein will be explained below.

The ESP system (100 in FIG. 1) may be moved into a well tubing to a selected depth. The ESP system may be deployed in the well tubing, for example, using a winch and electrical cable as shown in FIG. 1A.

A control signal may be sent from the surface, e.g., over the electrical cable (102 in FIG. 2) to operate valves in the valve sub (118 in FIG. 1) such that pressure from the pump discharge is communicated to the packer inflation port.

Valves in the valve sub (118 in FIG. 1) may be set by sending an electrical signal on the electrical cable, for example, using signal protocols known in the art, by sending a signal on dedicated electrical wiring in the electrical cable, or using a hydraulic line which may be incorporated in the electrical cable, or a separate hydraulic line. The foregoing are only intended to illustrate possible implementations of valve operation and are not intended to limit the scope of the present disclosure.

In some embodiments, a variable frequency AC motor drive may be configured to reverse the ordinary phase relationship of the electrical power output to the electric motor (108 in FIG. 1), such that the motor will operate in the opposite direction of rotation to that used during fluid pumping from the well to the surface. The pump thus generates pressure against the bottom check valve (120 in FIG. 1). The valves in the valve sub (118 in FIG. 1) may be operated to communicate the pump pressure to inflate the packer (3 in FIG. 1) by directing flow to the annular volume (16 in FIG. 3).

The electric motor (108 in FIG. 1) may be started in the opposite direction of rotation to that used during fluid pumping from the well to the surface to inflate the packer.

When the packer is inflated to the required inflation pressure, inflation pressure is trapped in the packer such that the packer will maintain a seal in the wellbore tubing which will support the pressure differential generated by the pump and so allow fluid to be pumped from the wellbore upwardly in the tubing. By gripping in the wellbore tubing, the packer may also provide torsional restraint for the ESP system. Packer inflation pressure may be trapped in the annular volume (16 in FIG. 4) by setting a valve, which may be a one-way valve, or alternatively a valve set by a signal communicated from the surface as explained with reference to FIG. 5.

The pressure limiting valves as described above may prevent the packer being over-pressurized and the pump from being 'dead headed' which could result in damage to the system due to overloading.

The electric motor is then stopped.

A control signal may then be sent from the surface, e.g., over the electrical cable (102 in FIG. 2) to operate valves in the valve sub (118 in FIG. 1) such that pressure is maintained in the packer, and flow from the pump discharge is directed to surface.

The electric motor may then be restarted in a normal or forward direction of rotation to cause the pump to lift fluid from the wellbore to the surface. Flow direction through the ESP system may be suitably directed by setting the control parameters in a variable speed drive (e.g., as may be disposed in the signal decoding sub (106 in FIG. 1).

When it is desired to retrieve the ESP system, or to move it to a different location in the wellbore, for example, deeper or shallower, the pump is stopped by control of the variable speed drive, a signal is sent to a valve in the setting sub which releases the inflation pressure from the packer to the wellbore, thereby releasing the packer from sealing in the wellbore. This may be the valve used to inflate the packer, or may be a separate valve as explained above.

The ESP system may then be moved to a different wellbore location or removed from the wellbore by winching on the electrical cable.

An example set of operations of setting the ESP system, pumping, and unsetting can be repeated as required. The example operating sequence may be summarized in TABLE 1.

TABLE 1

Sequence of operations

| STEP | PUMP | INFLATION VALVE | DEFLATION VALVE | PACKER | OPERATION PERFORMED |
|---|---|---|---|---|---|
| 1 | OFF | CLOSED | OPEN | DEFLATED | System run in to position |
| 2 | OFF | OPEN | CLOSED | DEFLATED | Open valve |
| 3 | REVERSE | OPEN | CLOSED | INFLATING | Set packer |
| 4 | REVERSE | CLOSED | CLOSED | INFLATED | Close valve |
| 5 | FORWARD | CLOSED | CLOSED | INFLATED | Producing |
| 6 | OFF | CLOSED | CLOSED | INFLATED | Stop pump |
| 7 | OFF | OPEN | OPEN | DEFLATING | Packer unset to reposition pump |

An ESP system and method for operating according to the present disclosure may provide the capability of repeated setting, pumping fluid to surface and releasing the system for further movement or retrieval from the wellbore without the need for additional pumps to inflate and deflate an inflatable seal, and may provide such capabilities without the need to remove the wellbore tubing.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An electrical submersible pump (ESP) system, comprising:

an electric motor operably coupled to a fluid pump having first and second ports selectively operable as a pump inlet and a pump discharge with reversal of a direction of rotation of the fluid pump;

an inflatable seal element; and controllable valves to selectively direct fluid discharge of the fluid pump to an inflation volume of the inflatable seal element and toward the surface in a wellbore.

2. The ESP system of claim 1 wherein the fluid pump is a progressing cavity pump.

3. The ESP system of claim 1 further comprising a torque converter disposed between the electric motor and the fluid pump.

4. The ESP system of claim 1 further comprising a protector disposed between the electric motor and the fluid pump.

5. The ESP system of claim 1 further comprising a torque anchor.

6. The ESP system of claim 1 further comprising a cable head coupled to a longitudinal end of the electric motor, the cable head configured to couple the ESP system to an electrical cable.

7. The ESP system of claim 6, wherein the electrical cable is for moving the ESP system along an interior of the wellbore.

8. The ESP system of claim 7, wherein the electrical cable is connected to the ESP system by a swivel connection.

9. The ESP system of claim 1 wherein the electric motor is operable to rotate the fluid pump in a first direction in which the first fluid port functions as the pump discharge and the second fluid port functions as the pump inlet, with the valves controlled to hydraulically connect the first fluid port to the inflation volume, whereby operation of the fluid pump introduces fluid under pressure to the inflation volume in the inflatable seal element.

10. The ESP system of claim 9 wherein the electric motor is operable to rotate the fluid pump in a second direction opposite to the first direction, in which the first fluid port functions as the pump inlet and the second fluid port functions as the pump discharge, with the valves controlled to hydraulically connect the first fluid port to the wellbore on one side of the inflatable seal element and to hydraulically connect the second port to the wellbore on an opposite side of the inflatable seal element.

11. The ESP system of claim 1 wherein signals to operate the controllable valves are electrical signals transmitted over an electrical cable.

12. The ESP system of claim 1 further comprising a pressure relief valve in hydraulic communication between the second fluid port on the fluid pump and the wellbore.

13. The ESP system of claim 1 further comprising a pressure relief valve in hydraulic communication between the inflation volume and the wellbore tubing.

14. The ESP system of claim 1 further comprising a check valve operable to admit fluid to the first fluid port when the fluid pump is rotated such that the first fluid port operates as the pump inlet, the check valve operable to stop fluid flow therethrough when the fluid pump is rotated such that the first fluid port operates as the pump discharge.

15. The ESP system of claim 1, wherein the controllable valves are further controllable to vent pressure in the inflation volume to deflate the inflatable seal element.

16. The ESP system of claim 15, further comprising an inflate port in a tubular core to permit fluid communication between the through bore of the tubular core and the inflation volume of the inflatable seal element.

17. The ESP system of claim 15, wherein one of the controllable valves is operable to selectively permit fluid communication through an inflate port.

18. The ESP system of claim 1, further comprising a tubular core having a through bore in fluid communication with the first fluid port, wherein the inflatable seal element is mounted around the tubular core.

19. A method for pumping fluid from a wellbore towards surface, comprising:

a) moving an electrical submersible pump (ESP) system to a selected position in the wellbore, wherein the ESP system includes a fluid pump having first and second ports selectively operable as a pump inlet and a pump discharge with reversal of a direction of rotation of the fluid pump;

b) rotating the fluid pump in a first direction and operating valves in the ESP system to direct fluid discharge from the fluid pump to an inflatable seal element in the ESP system; and c) rotating the fluid pump in a second direction opposed to the first direction and operating the valves to direct fluid discharge from the pump towards the surface in the wellbore.

20. The method of claim 19, further comprising operating the valves and rotating the fluid pump in the first direction such that the second port in the fluid pump in the ESP system withdraws fluid from the wellbore into the fluid pump and the first port in the fluid pump discharges fluid into the inflatable seal element in the ESP system.

21. The method of claim 19, further comprising operating the valves and rotating the fluid pump in the second direction such that the first port withdraws fluid from the wellbore on one side of the inflatable seal element and the second port discharges fluid into the wellbore on an opposite side of the inflatable seal element toward the surface.

22. The method of claim 19, wherein rotating the fluid pump in the first and second directions comprises operating an electric motor rotationally coupled to the fluid pump in the first and second directions.

23. The method of claim 19 further comprising operating the valves to at least partially vent fluid pressure from the inflatable seal element.

24. The method of claim 23, further comprising moving the ESP system within the wellbore following at least partially venting fluid pressure from the inflatable seal element.

25. The method of claim 24, further comprising moving the ESP system to a different position within the wellbore and repeating (b) at the different position.

26. The method of claim 25, further comprising repeating (c) at the different position.

27. The method of claim 25, further comprising moving the ESP system to retrieve the ESP system from the wellbore following at least partially venting fluid pressure from the inflatable seal element.

28. The method of claim 25, further comprising releasing a set torque anchor prior to moving the ESP system by applying an upward axial force on the ESP system.

29. The method of claim 19, further comprising venting pressure above a preselected amount from the interior of the inflatable seal element.

30. The method of claim 19, further comprising venting pressure above a preselected amount from the fluid pump when the fluid pump is operated in the first direction.

31. The method of claim 19, wherein moving the ESP system comprises extending and/or retracting an electrical cable coupled to a longitudinal end of the ESP system.

32. The method of claim 19, further comprising setting a torque anchor to rotationally lock the ESP system in a conduit in the wellbore.

33. The method of claim 32, wherein setting the torque anchor comprises starting rotation of the pump to deploy locking arms by centripetal force.

* * * * *